United States Patent [19]

Marello et al.

[11] Patent Number: 5,011,144

[45] Date of Patent: Apr. 30, 1991

[54] BALL PRACTICE TEE

[75] Inventors: Hugo Marello, 119 Elgin Street, Thornhill, Ontario, Canada, L3T 1W7; James Allan, West Vancouver, Canada

[73] Assignee: Hugo Marello, Thornhill, Canada

[21] Appl. No.: 372,854

[22] Filed: Jun. 29, 1989

Related U.S. Application Data

[63] Continuation-in-part of Ser. No. 137,574, Jan. 24, 1987, abandoned.

[51] Int. Cl.[5] ..... A63B 69/38

[52] U.S. Cl. ..... 273/29; 273/26 R; 446/179

[58] Field of Search ..... 273/29 A, 26 R, 26 D, 273/201, 359, 399, 397, 126 R, 369; 446/179

[56] References Cited

U.S. PATENT DOCUMENTS

| | | | |
|---|---|---|---|
| 2,335,280 | 11/1943 | Hageberg | 273/201 |
| 2,903,817 | 9/1959 | McLain et al. | 446/179 |
| 3,083,497 | 4/1963 | Novak et al. | 446/179 |
| 3,297,324 | 1/1967 | Evans | 273/397 |
| 3,887,182 | 6/1975 | Breslow | 446/179 |
| 4,050,906 | 9/1977 | Goldfard et al. | 273/359 |
| 4,211,412 | 7/1980 | Barlow et al. | 446/179 |
| 4,564,195 | 1/1986 | McClure et al. | 273/26 R |
| 4,575,080 | 3/1986 | Miles | 273/26 R |

FOREIGN PATENT DOCUMENTS

| | | | |
|---|---|---|---|
| 813051 | 5/1937 | France | 273/399 |

*Primary Examiner*—Theatrice Brown
*Attorney, Agent, or Firm*—Smart & Biggar

[57] ABSTRACT

The invention is directed to a ball support practice tee whereby a ball is suspended on a column of air. The apparatus involves a housing having an annular cone shaped nozzle extending upwardly therefrom. Within the nozzle is placed a blind core which prevents axial flow of air from the nozzle, but will cause air to flow between the nozzle and the inner surface of the nozzle to produce an annular flow of air from the nozzle, thus suspending a ball. A compressor is placed within the housing for producing a supply of air under pressure through the nozzle.

9 Claims, 2 Drawing Sheets

BALL PRACTICE TEE

This is a continuation-in-part of U.S. application Ser. No. 07/137,574, filed Dec. 24, 1987, abandoned.

FIELD OF THE INVENTION

This invention relates to a ball practice tee by which a tennis ball or the like is freely supported in mid-air by an air jet, enabling it to be struck by a player.

BACKGROUND OF THE INVENTION

Devices are known which employ an air jet to hold a ball in an elevated position. Such a device is shown in U.S. Pat. No. 4,564,195, issued Jan. 14, 1986, in the name of R. H. McClure, et al, in which a ball rides on a jet of air emanating upwardly from a nozzle. The purpose of these devices is to enable a player to practice without a second player. Moreover, unlike simply hitting a ball against a wall or hitting a ball attached to a tether string, these devices are intended to support the ball in a relatively stationary position.

In practice, however, it has been found that these prior known devices do not support a ball in a stable, mid-air position. By simply employing a straight flow-through nozzle through which an air jet passes, the ball is elevated to the level at which the lift provided by the air jet is equal to the weight of the ball. However, the only support which is provided to the ball is directly upward, which makes the ball highly susceptible to movement and instability caused by atmospheric wind and the like.

SUMMARY OF THE INVENTION

It is an object of the present invention to provide a device which will support a ball in mid-air in a stable position, enabling it to be struck by a player.

It is a further object of the present invention to provide a device which will support a ball in mid-air, in a stable position, so that the effects of atmospheric wind are minimized.

In its broadest aspect, the present invention consists of a ball practice tee, for use with tennis balls or the like, comprising a frame; a vertically oriented shallowly tapering nozzle having a coaxial core, mounted on the frame and having an annular outlet orifice; and compressor means actuable to supply air under pressure to the nozzle whereby an annular flow of air issues from the nozzle to stably support a ball in mid-air above the nozzle.

BRIEF DESCRIPTION OF THE DRAWINGS

An example embodiment of the invention is shown in the accompanying drawings in which.

DESCRIPTION OF PREFERRED EMBODIMENT

Figure 2:
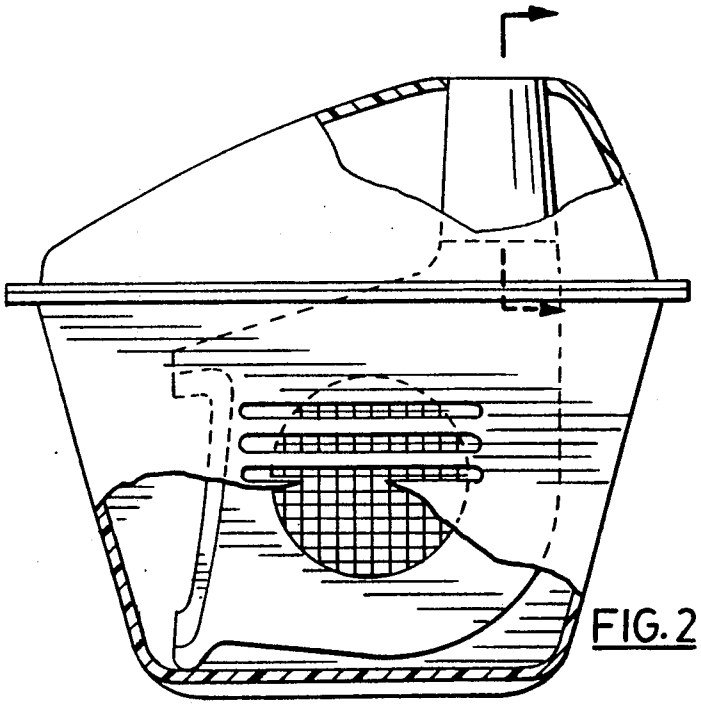
FIG. 2 is a side view of the ball practice tee of FIG. 1 in partial cross-section.
Figure 1:
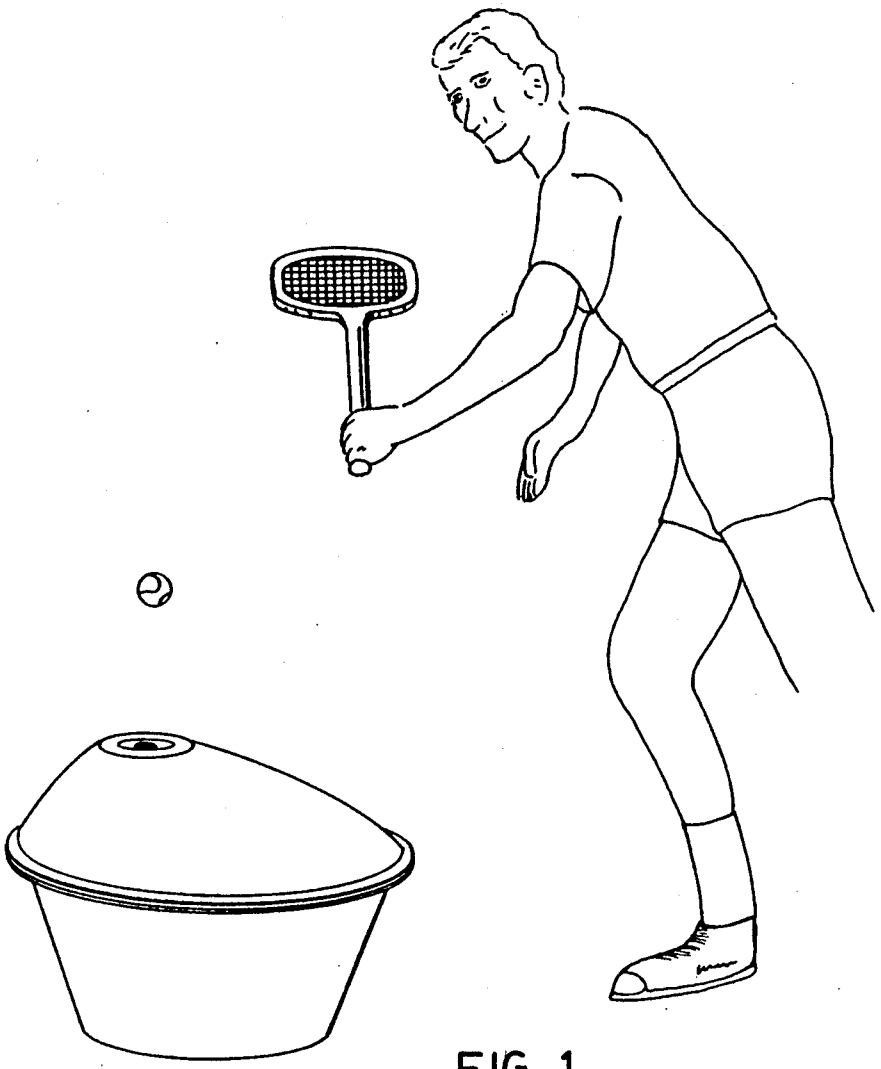
FIG. 1 is a perspective view of a ball practice tee in use.

The example embodiment shown in the drawings consists of a ball practice tee 10 having a frame in the form of a housing 12 enclosing a plenum chamber 14. Positioned within chamber 14 is a variable speed air compressor 16. Air intake slots 18 are located in the side of the housing 12 and permit air to flow into plenum chamber 14 to compressor 16.

Figure 5:
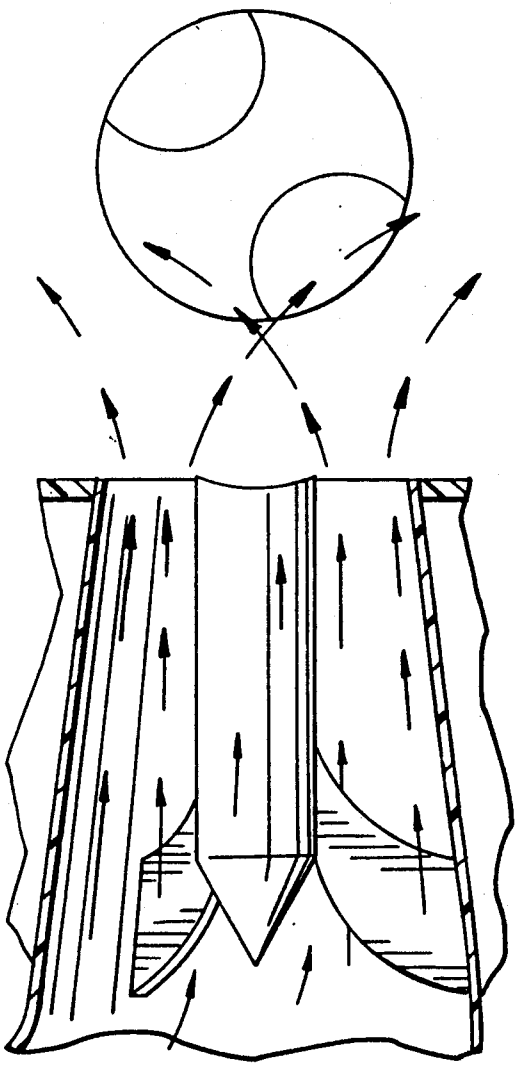
FIG. 5 is a cross-sectional view of the nozzle as shown in FIG. 4, with the ball supported in mid-air by an air jet.
Figure 4:
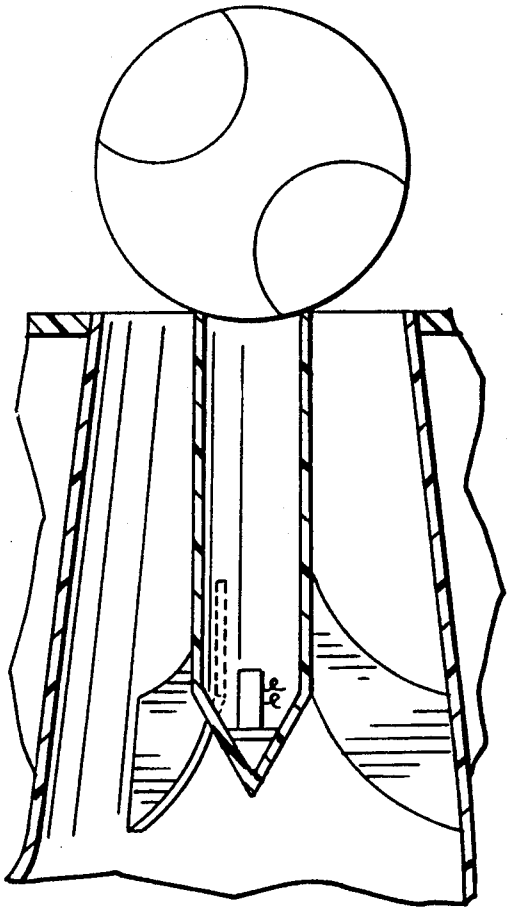
FIG. 4 is a cross-sectional view of the nozzle as shown in FIG. 3, with a ball placed on top of the nozzle.
Figure 3:
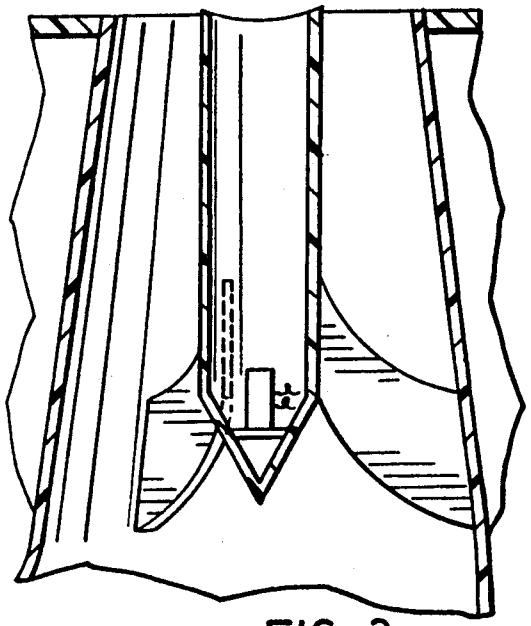
FIG. 3 is a cross-sectional view of the nozzle of the ball practice tee of FIG. 1.

As seen in FIGS. 3 to 5, the outlet of compressor 16 comprises a shallowly tapered, vertically oriented, frustoconical nozzle 20, having an outlet end 22 which is flush with an aperture 24 in the top of housing 12. The term "shallow taper" means a wall taper of low angle with respect to the axis of nozzle 20, as seen in FIGS. 3 to 5. A tubular core 30 is fixed coaxially in nozzle 20 by a plurality of ribs 32, thereby creating an annular outlet passage 34 terminating in the annular outlet orifice 35. A photoelectric cell 36 situated at the closed bottom end 38 of core 30 (i.e. a blind core) is electrically connected with an on-off switch (not shown) of compressor 16.

In the operation of the apparatus shown in the drawings, a ball 40, such as a tennis ball, is placed on the upper end of core 30 at outlet end 22 of ball practice tee 10 as seen in FIG. 4 of the drawings. Photoelectric cell 36 detects the presence of the ball 40 on the ball practice tee because light entering core 30 is cut off, thereby activating the cell, which switches on air compressor 16. Air compressor 16 draws air from plenum chamber 14 and a flow of compressed air travels through annular outlet passage 34 of nozzle 20 to outlet orifice 35. As the annular flow of compressed air exits from nozzle 20 as a column it expands laterally and creates both a converging flow of air as indicated by arrows 41 of FIG. 5 and a diverging flow of air as indicated by arrows 42 in FIG. 5. Ball 40 is elevated by this air flow, and is stably cradled directly above core 30 as the outer portion of the expanding annular column of air diverges (arrows 42). As a result, ball 40 is supported from below by the air flow and at the same time the ball is urged to remain in a stable central position above nozzle 20 by the flow of air across the central axis of nozzle 20.

Ball 40 can be supported at a pre-selected position above nozzle 20 by varying the flow of air from air compressor 16, i.e. by varying the speed of the compressor.

It will be appreciated that core 30, which is provided within nozzle 20, need not be hollow and could be a solid core adapted to support a ball when ball practice tee 10 is not activated. Using such a solid core, compressor 16 would be activated by a manual switch.

Practice tee 10 operates most effectively when air compressor 16 delivers a high volume of air at a low pressure, preferably in the range of 300 to 400 cfm at between 5 and 30 psi. Also a taper of between 6% and 20% of nozzle 20 gives most effective operation. In a specific construction of the example embodiment, nozzle 20 has an internal diameter of 2" at its orifice, core 30 has an outer diameter of ¾", the internal taper of the nozzle is 13/32" in 3¼" (1 in 8 or 12.5%, i.e. a shallow taper), and air compressor 16 is a 7 ampere, 1 horsepower variable speed motor having an output of 345 cfm. In operation this specific embodiment supports a tennis ball 10" to 12" above orifice 35 of nozzle 20.

We claim:

1. A ball practice tee comprising:

a housing;

an air compressor positioned within the housing; and a vertically oriented frusto-conical outlet nozzle of shallow taper connected to the compressor and opening from the housing, the nozzle having a coaxial blind core fixed within said nozzle and forming with the nozzle and annular outlet passage whereby air will pass from said nozzle only between said core and said nozzle, and whereby upon actuation of the compressor a laterally expanding annular air flow issues from the nozzle to stably support a ball in mid-air centrally above the nozzle.

2. A ball practice tee as claimed in claim 1 in which the compressor means includes on-off switching means, a photoelectric cell electrically connected with the switching means, the core being tubular and containing the photoelectric cell, the photoelectric cell being activated when a ball is placed on the outlet orifice of the nozzle.

3. A ball practice tee as claimed in claim 1 in which the taper of the outlet nozzle is between 6% and 20%.

4. A ball practice tee as claimed in claim 1 in which the taper of the outlet nozzle is 12.5%.

5. A ball practice tee comprising:

a frame;

a vertically oriented nozzle mounted on the frame and having a shallow taper, an annular outlet orifice, and a coaxial blind core fixed in said nozzle, said core having an outer transversal dimension less than the inner transverse dimension of said outlet orifice to form an annular outlet passage terminating in the outlet orifice whereby air is allowed to pass from said orifice only between said outer transverse dimension of said core and the inner transverse dimension of said nozzle; and compressor means connected to the nozzle and actuable to supply air thereto under pressure to provide a laterally expanding annular flow of air issuing from the nozzle whereby a ball is stably supportable in mid-air centrally above the nozzle.

6. A ball practice tee as claimed in claim 5 in which the nozzle is frusto-conical.

7. A ball practice tee as claimed in claim 5 wherein the compressor means includes means to vary the flow of air issuing from the nozzle whereby the height at which the ball is supported above the nozzle is selectively adjustable.

8. A ball practice tee as claimed in claim 5 in which the compressor means includes on-off switching means, and means to actuate the switching means when a ball is placed on the nozzle.

9. A ball practice tee as claimed in claim 5 in which the compressor means includes on-off switching means, a photoelectric cell electrically connected with the switching means, the core being tubular and containing a photoelectric cell, the photoelectric cell being activated when a ball is placed on the outlet orifice of the nozzle.

* * * * *

UNITED STATES PATENT AND TRADEMARK OFFICE

CERTIFICATE OF CORRECTION

PATENT NO. : 5,011,144

DATED : April 30, 1991

INVENTOR(S) : Hugo Marrello and James Allan

It is certified that error appears in the above-identified patent and that said Letters Patent is hereby corrected as shown below:

The name of the inventor and assignee "Hugo Marello" should read -- Hugo Marrello --

Signed and Sealed this

Twenty-fifth Day of August, 1992

*Attest:*

*Attesting Officer*

DOUGLAS B. COMER

*Acting Commissioner of Patents and Trademarks*